US005433687A

United States Patent [19]

Hinzman et al.

[11] Patent Number: 5,433,687

[45] Date of Patent: Jul. 18, 1995

[54] FREE-WEIGHT EXERCISE APPARATUS

[76] Inventors: August O. Hinzman, Rte. 4, Box 130; Larry G. Beck, 1722 Harris St.; Christopher K. Hinzman, Rte. 4, Box 130, all of Gainesville, Tex. 76246

[21] Appl. No.: 248,413

[22] Filed: May 24, 1994

Related U.S. Application Data

[63] Continuation-in-part of Ser. No. 156,981, Nov. 15, 1993, abandoned.

[51] Int. Cl.[6] ..... A63B 21/078

[52] U.S. Cl. ..... 482/104; 267/169; 298/580

[58] Field of Search ..... 482/77, 94, 97, 104, 482/128, 148; 298/500, 618, 624; 267/140.5, 169, 291

[56] References Cited

U.S. PATENT DOCUMENTS

| | | | |
|---|---|---|---|
| 290,860 | 12/1883 | Cole | 267/169 |
| 2,743,926 | 5/1956 | Klein | 982/128 X |
| 4,620,701 | 11/1986 | Mojden . | |
| 4,637,608 | 1/1987 | Owens et al. . | |
| 4,645,196 | 2/1987 | Christie . | |
| 4,729,561 | 3/1988 | Desjardins . | |
| 4,744,560 | 5/1988 | Azari . | |
| 4,749,190 | 6/1988 | Jennings . | |
| 4,832,334 | 5/1989 | Mullen . | |
| 4,861,024 | 8/1989 | Lee . | |
| 4,861,025 | 8/1989 | Rockwell . | |
| 5,060,939 | 10/1991 | Oswald et al. . | |
| 5,069,447 | 12/1991 | Snyderman et al. . | |
| 5,082,259 | 1/1992 | Gonzalez . | |
| 5,160,305 | 11/1992 | Lin . | |
| 5,162,031 | 11/1992 | Watson . | |

FOREIGN PATENT DOCUMENTS

| | | |
|---|---|---|
| 2627090A | 8/1989 | France . |
| 3423837A | 9/1986 | Germany . |

OTHER PUBLICATIONS

Advertisement for "The Pro Max Bench & Adjustable Squat Back" in *Coach & Athlete*, Mar. 1981, p. 62.

*Primary Examiner*—Richard J. Apley
*Assistant Examiner*—John Mulcahy
*Attorney, Agent, or Firm*—Crutsinger & Booth

[57] ABSTRACT

According to one aspect of the invention, a free-weight exercise apparatus is provided that includes a left standard and a right standard that are removably joined in spaced-apart relationship by a cross connector. The left and right standards are preferably generally triangular in shape. According to another aspect, an apparatus is provided for assisting a person with dead-lift type exercises. The apparatus includes left and right lifter assemblies, each of which has an upper bar and a lower bar, the bars being maintained in a parallel, spaced-apart relationship by two vertically oriented piston-cylinder units. A spring is positioned co-axially around each of the piston-cylinder units. One of the ends of one of the two piston-cylinder units of each assembly is pivotally connected to one of the bars and the other ends of the two piston-cylinder units are rigidly connected to the bars, whereby binding of the piston-cylinder units is prevented. According to yet another aspect of the invention, an adjustable bench is provided for bench press exercises. The bench press has a toe board and a head board that are pivotally interconnected so that the toe board and head board can be simultaneously moved between a horizontal and an inclined position with a single adjustment motion. All the aspects of the invention can be combined into one exercise apparatus.

10 Claims, 6 Drawing Sheets

FREE-WEIGHT EXERCISE APPARATUS

This is a continuation-in-part of prior U.S. patent application Ser. No. 08/156,981, filed Nov. 15, 1993, now abandoned.

TECHNICAL FIELD

This invention relates to equipment that is used to assist a person in properly and more safely performing weight-lifting exercises with free weights.

BACKGROUND OF THE INVENTION

There are many different types of free-weight exercises for body building. In a gym for professional weight lifters and body builders, there is often a separate piece of exercise equipment for each type of major exercise.

For example, there is a flat padded bench with an overhead barbell weight rack for performing a normal, horizontal bench-press exercise, which is important for overall chest muscle development. Then there is an inclined bench for performing inclined bench-press exercises, which focuses the muscle development in a specific portion of the chest musculature. The inclined bench has a head board (for back support) and a toe board (a seat), both of which are fixed in an inclined position. The head board is preferably positioned at an angle of about 45° to 60° to the horizontal. Some gyms have more than one fixed incline bench, for example, one having a head board inclined at about 45° and another having a head board inclined at about 60° to the floor. Most preferably, the toe board is inclined perpendicularly to the incline of the head board so that a person performing the inclined bench-press exercise does not slide off the bench. Because the toe board of a fixed incline bench is not adjustable, the inclined bench press apparatus cannot be adjusted for the horizontal bench-press exercise.

In some apparatus, attempts have been made to combine the horizontal bench-press apparatus and the inclined bench-press apparatus by making the angle of the head board adjustable, but the angle of the toe board is not. See for example, the apparatuses of the types shown in the following patents: U.S. Pat. No. 4,749,190 issued to Homer F. Jennings on Jun. 7, 1988; U.S. Pat. No. 4,645,196 issued to Larry L. Christie on Feb. 24, 1987; U.S. Pat. No. 5,160,305 issued to Paul Lin on Nov. 3, 1992; and French Patent No. 2627-090. This solution is unsatisfactory because if the toe board is not inclined, preferably perpendicularly to the head board, a person performing an inclined bench-press exercise on the bench tends to slide off the horizontal toe board.

In other combined apparatuses, the head board and the toe board must be adjusted separately. See for example, U.S. Pat. No. 5,069,447 issued to Fredric Snyderman and Robert H. Russell on Dec. 3, 1991, U.S. Pat. No. 5,082,259 issued to Karl Gonzalez on Jan. 21, 1992, and German Patent No. 3423-837 issued to Heinz Kettler. The adjustments of these combined benches is tedious and troublesome, which tends to discourage the full use of the equipment. That making adjustments would discourage a weight lifter might seem surprising, but the exercises require tremendous effort and focused concentration; a weight lifter wants to concentrate on lifting weights, not wasting precious time and concentration on making tedious adjustments in the equipment. Furthermore, even where the toe board is adjustable, in the apparatuses disclosed in these patents the toe board is not adjustable at a proper angle, which most preferably should be positioned perpendicular to the inclined head board.

Some of the other exercises that are very important are the dead lift, where a barbell is brought from the floor up to the waist, and the "power cling," where a barbell is brought up to the chest. For the purposes of this description, a "dead-lift type exercise" is any exercise that involves lifting the dead weight of a barbell up from floor level while the lifter is in a standing or squaring position. The most difficult stage of these exercises is starting the movement of the barbell upward from floor level. The most difficult stage, or weak stage, of an exercise can limit the weight a person can work with, which limits the benefits of the exercise for the muscle groups used during stronger stages of the exercise.

U.S. Pat. No. 4,832,334 issued to Karl I. Mullen on May 23, 1989, shows a power cage intended to help lifters through the weak points of a dead lift type exercise so that the proper amount of weight can be carried through the strong point of the lift. But there are many drawbacks to the power cage shown in U.S. Pat. No. 4,832,334. One problem with the power cage is that to be effective, it must be enormous in size, at least about 4 feet by 4 feet at the base and 6 feet tall for performing a power cling exercise, for example. Another problem with the power cage is that when a barbell is placed on the spring supported movable beams, any slight deviation from the horizontal will cause the barbell to roll forward or backward in the cage. This will cause one end of the beams to move downward under the shifting weight of the barbell which counterbalances one spring, while the other end moves up under the force of the other expanding spring. This will invariably cause the beams of the apparatus to deviate from the horizontal and bind on the vertical guide bars. The same binding of the apparatus to the vertical guide bars will also result if the barbell on the downward stroke strikes anything other than the center of the beams. Yet another drawback of the power cage shown in U.S. Pat. No. 4,832,334 is that the shock of dropping a heavy weight on the beams is absorbed by the springs, which are not vertically restrained. The springs could bow outward from the vertical, perhaps even break, thus, creating a danger to nearby persons.

For maximum benefit, a body-building workout requires taking the muscles to the limit of complete exhaustion, which is felt as intense muscle pain, the so-called point of muscle "burn." To achieve complete muscle exhaustion and maximum muscle burn, an exercise is usually performed in several "sets" of repeated lifts. For example, a person selects a maximum weight for an exercise, such as a bench press, for which he or she can perform three sets the bench presses of eight to twelve repetitions per set. Particularly toward the end of the last set of the exercises, the muscle becomes so fatigued and the burn so intense that a person can run the risk of becoming unable to raise the barbell to the rack one last time, thereby essentially becoming pinned under the weight. Thus, weight lifters should usually use a "spotter", who is a second person standing ready to assist with the exercise. But sometimes a spotter is not available, particularly in a home-gym situation. Thus, the rack should also serve a minimal safety function.

Another problem with conventional home-gym equipment is that it tends to be unsteady, sometimes even bordering on the dangerous when loaded with heavy weight. To achieve the required stability, professional equipment is usually extremely heavy, but this solution is not cost effective or appropriate for home gym purposes.

Thus, there is a long-felt need for exercise equipment that solves these and other problems with the previously known equipment.

SUMMARY OF THE INVENTION

According to one aspect of the invention, a free-weight exercise apparatus is provided that includes a left standard and a right standard that are removably joined in spaced-apart relationship by a cross connector. The left and right standards are preferably generally triangular in shape, having a back leg and a front leg, and intermediate braces. The generally triangular configuration provides structural stability to the standards, which allows reduction in the weight of the structural members while still achieving stability in the apparatus.

Each of the standards preferably has several barbell weight holders. The holders allow barbell weights to be stored directly on the standards of the apparatus for ready access, but completely out of the way of a person using the equipment.

Each of the back legs of the left and right standards, respectively, preferably has several barbell squat pegs. The squat pegs are preferably positioned at uniformly spaced-apart intervals along the rear facing side of the back legs. Each of the squat pegs is formed of short lengths, several inches for example, of round metal rod that is welded to have about a ten degree (10°) rise in elevation to the horizontal. The several pairs of squat pegs are positioned on each of the back legs of the left and right standards, respectively, to accommodate a range of the shoulder heights of different persons who are expected to use the squat pegs for squat or other exercises.

Each of the back legs of the left and right standards also preferably has a squat safety peg. The squat safety pegs are preferably positioned at a relatively low height of a person's shoulders who is in a fully squatted position. Each of the squat safety pegs is formed of short lengths, several inches for example, of round metal rod that is welded to have about a ten degree (10°) rise in elevation to the horizontal. The squat safety pegs are preferably more substantial than the other squat pegs because they may have to bear the force of a heavily loaded barbell moving downward with less control than normal. But a lifter should not perform heavy barbell exercises without having a spotter for safety. These squat safety pegs stop the downward movement of the barbell and protect the person doing the squat exercise in case the weight is too heavy for the person to lift the loaded barbell back up to one of the shoulder height squat pegs.

Each of the front legs of the left and right standards preferably has several barbell bench-press pegs. The bench-press pegs are preferably positioned at uniformly spaced-apart intervals along the front facing side of the front legs. Each of the bench-press pegs is formed of short lengths, several inches for example, of round metal rod that is welded to have about a ten degree (10°) rise in elevation to the horizontal. The several pairs of bench-press pegs are positioned on each of the front legs of the left and right standards, respectively, at a height to accommodate a wide range fiat and inclined bench-press exercises for a person using the adjustable bench assembly.

According to another aspect of the invention, an adjustable bench assembly is provided. According to a preferred embodiment of this aspect of the invention, the adjustable bench assembly is removably connected to the cross connector between the left and right standards of the free-weight exercise apparatus. The bench assembly includes a track and a toe board support arm, which are supported by a leg structure. The bench assembly also has a toe board and a head board.

One side of the toe board is adjacent one edge of the head board, and the two boards are pivotally connected by a hinge along these adjacent edges. One end of a linkage arm is pivotally connected to the back of the toe board, and the other end is pivotally connected to the toe board support arm. The end of the head board near the hinge with the toe board is pivotally connected to one end of the track. The other end of the head board has one end of a head board arm pivotally mounted to the back. A track follower is attached to the other end of the head board arm. The pivotally connected head board arm can move with the follower along the track. Thus, the pivotal geometry of the assembly allows the toe board and head board pivot reciprocally between a horizontal position and a range of inclined positions, such that in an inclined position the head board is inclined between about 45° to about 60° to the horizontal and the toe board is inclined substantially perpendicular to the head board.

A plurality of apertures are formed in the track. The apertures are formed as spaced apart intervals along the length of at least a portion of the track. A pin, or more preferably a lock plate with one or more pins, is used to adjustably retain the head board arm in a desired position along the track by aligning one or more pegs with the apertures formed in the track.

When the follower is moved all the way to one end of the track, the head board arm fits into the track, and the toe board and head board move into a horizontal position for normal bench press exercises. To move the toe board and head board into an inclined position, the head board is lifted to an inclined position so that the follower moves along the track. The pin or lock plate is positioned in one of the apertures in the track to retain the head board arm in the desired inclined position, preferably at an angle in the range of about 45° to 60°. The toe board is automatically and reciprocally moved into the correct position to retain a person on the bench while performing incline an bench-press exercise.

According to yet another aspect of the invention, left and right barbell lifter assemblies are provided. The lifter assemblies are used to assist a person in a dead-lift type exercise by reducing the amount of effort required to start the upward motion of the barbell. The lifter assemblies can be used to assist with any type of exercise in which a barbell is lifted from about ground level.

Each of the lifter assemblies include an upper bar and a lower bar. The two bars are maintained in parallel, aligned and spaced-apart relationship by a pair of piston-cylinder units. The piston-cylinder units are not required to be pneumatic, but are used to maintain the spaced-apart relationship of the upper and lower bars. One end of one of the two piston-cylinder units is pivotally connected to one of the bars; the other ends of the two piston-cylinder units are rigidly attached to the upper and lower bars. The pivotal connection of one end of the two piston-cylinder units is important because it allows play in the exact alignment of the piston-cylinder unit, which prevents the two units of the assembly from binding. Thus, the weight of the barbell does not bind the lift assemblies even if the barbell is not centered between the two piston-cylinder units of the lifter assemblies.

A spring is positioned circumferentially and co-axially around each of the piston-cylinder units of a lifter assembly. The springs assist in counterbalancing some of the weight of a barbell and absorbs some of the shock of a dropping barbell. The inner piston-cylinder units keep the springs in vertical alignment. The springs of each of the lifter assemblies absorb at least some of the impact of the barbell. The piston-cylinder units maintain the springs in alignment and prevent them from popping out of vertical position.

In a preferred embodiment of the invention, the lift assemblies are removably connected to the left and right standards, respectively, of the free-weight exercise apparatus. Each of the left and right standards preferably has a lifter assembly retainer. The retainer defines a vertical slot. The lifter assemblies are removably connected to the retainers. One end of the upper arm of each lift assembly has an extension portion for removably connecting the lifter assembly to one of the standards. The extension portion is connected to the retainer on the standard. Since the upper arm must be able to reciprocated up and down under the load of a barbell, the extension portion of the upper arm is slidably connected to move in the slot of the retainer.

These and other aspects of the invention provide an apparatus to assist a person with several different types of free-weight exercises, such as squats, curls, reverse curls, hanging clings, bench presses, inclined bench presses, dead lifts, and power clings. These and other features, advantages, and objects of the present invention will be apparent to those skilled in the art upon reading the following detailed description of preferred embodiments together with the drawings.

BRIEF DESCRIPTION OF THE DRAWINGS

The accompanying drawings are incorporated into and form a part of the specification to illustrate several examples of the present invention. These drawings together with the description serve to explain the principles of the invention. The drawings are only for the purpose of illustrating preferred and alternative examples of how the invention can be made and used and are not to be construed as limiting the invention to only the illustrated and described examples. The various advantages and features of the present invention will be apparent from a consideration of the drawings in which.

DETAILED DESCRIPTION OF PREFERRED EMBODIMENTS

Figure 1:
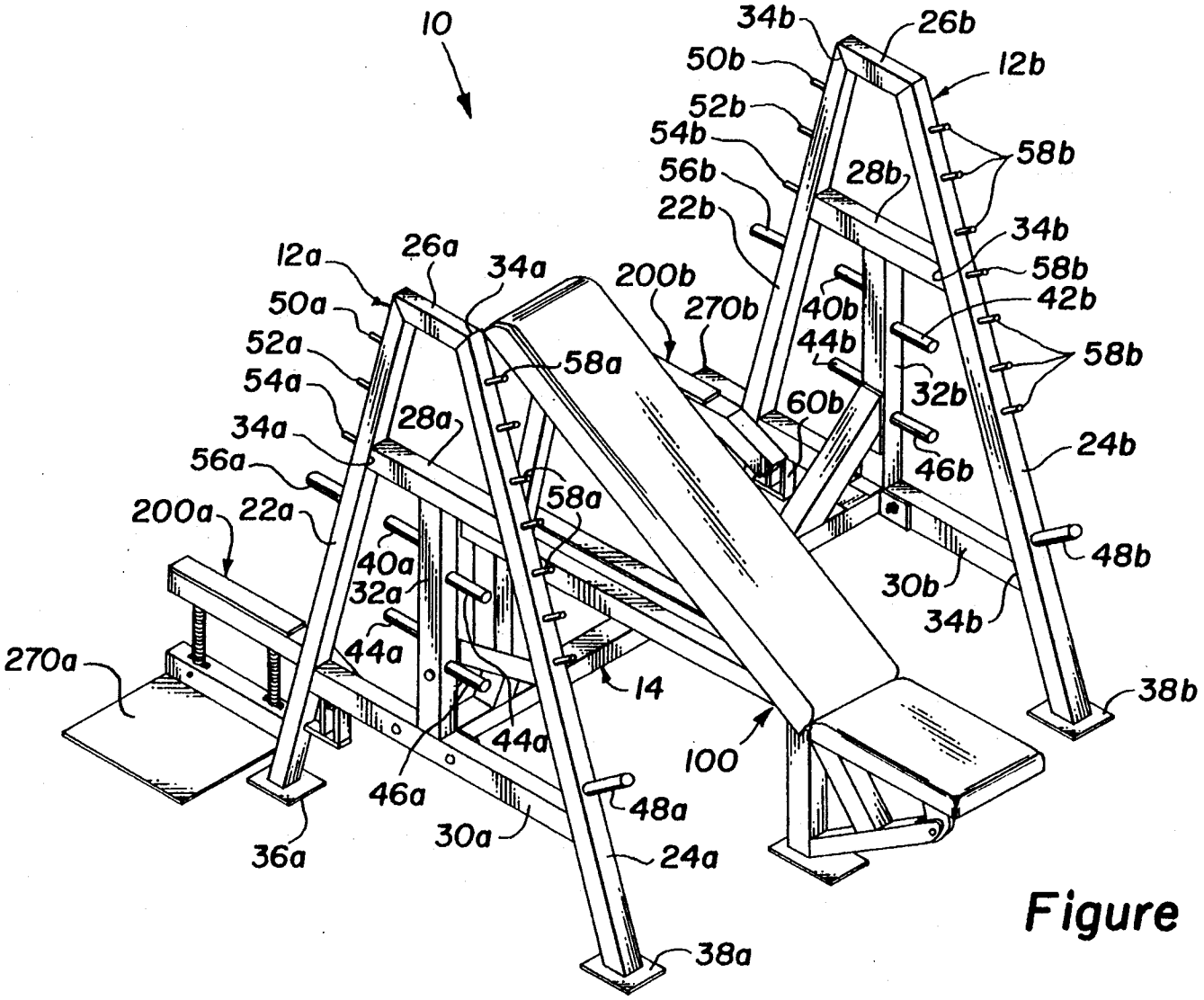
FIG. 1 is a perspective view of the free-weight exercise apparatus including the left and right standards, the cross connector, the adjustable bench assembly, and the barbell lifter assemblies.

The present invention will be described by referring to apparatuses, articles, and methods showing various examples of how the invention can be made and used. Like reference characters are used throughout the several views of the drawing to indicate like or corresponding parts. As used herein, the terms "front," "back," "forward," "rearward," "left," "right," "upper," and "lower" are used with reference to the orientation of the Figures of the drawings, and such terms are not intended to limit the invention.

FIG. 1 of the drawing is a perspective view of a free-weight exercise apparatus according to the presently most preferred embodiment of the invention. The apparatus is generally referred to by the reference numeral 10. As will be described in more detail, the free-weight exercise apparatus 10 generally includes a left standard 12*a* and a right standard 12*b*, which are removably joined in spaced-apart relationship by a cross connector 14. An adjustable bench assembly, generally referred to by the reference numeral 100 is removably connected to the cross connector 14 between the left and right standards 12*a* and 12*b*. The apparatus 10 preferably has left and right barbell lifter assemblies 200*a* and 200*b* removably connected to the left and right standards 12*a* and 12*b*, respectively. As will be explained in more detail, the apparatus 10 is adapted to assist a person with several different types of free-weight exercises, such as squats, curls, reverse curls, hanging clings, bench presses, dead lifts, and power clings.

Several people can use the apparatus 10 at the same time. For example, a team of two lifters can alternate using the bench assembly 100 for bench-press exercises, while another team of two lifters can alternate using the lifter assemblies 200*a* and 200*b*.

Left and right standards 12*a* and 12*b* are preferably identical. As will be described in more detail, left and right barbell lifter assemblies 200*a* and 200*b* are preferably almost identical. The use of these identical parts reduces the number of different parts required to manufacture the apparatus 10.

Figure 2:
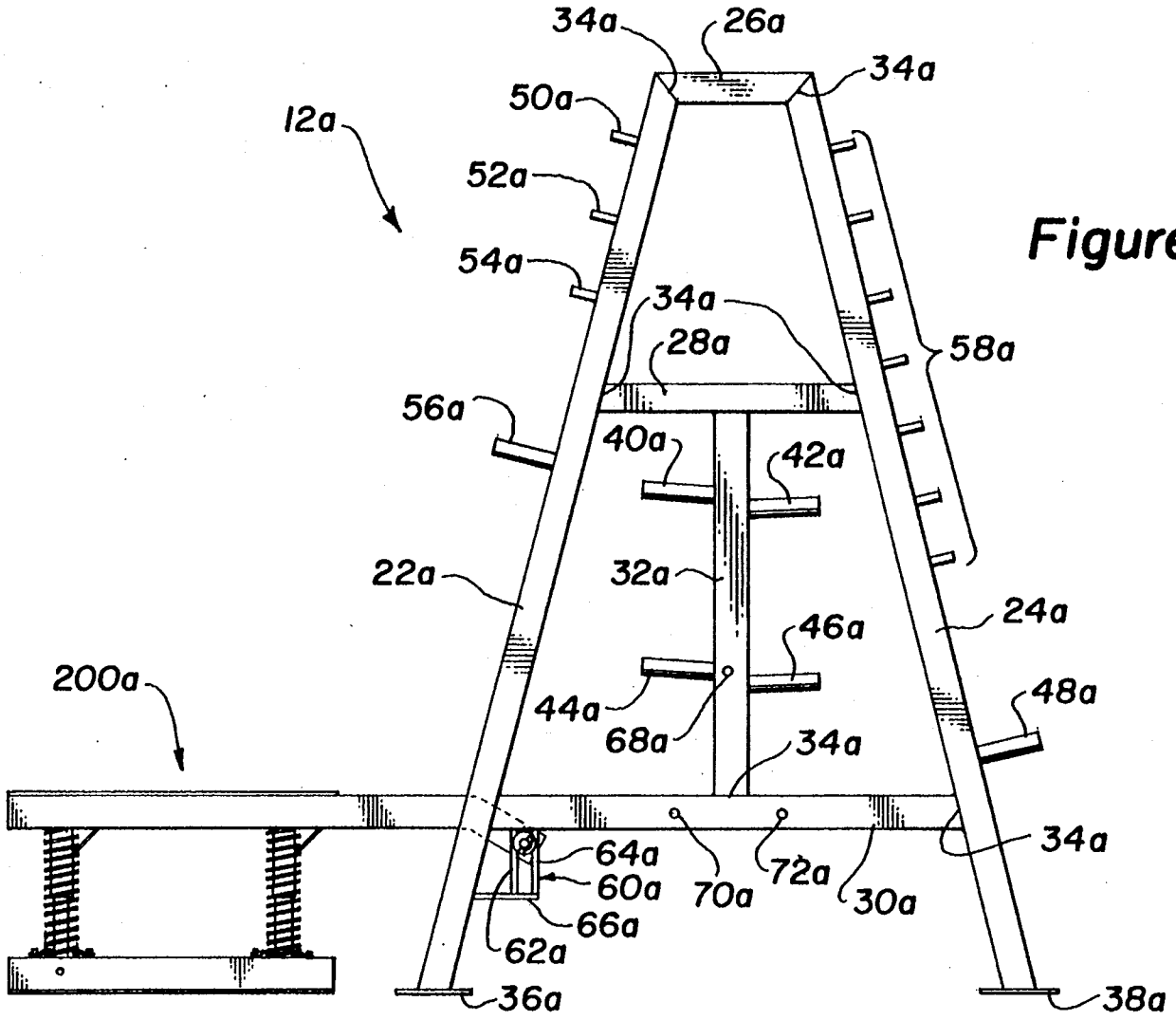
FIG. 2 is a side elevation view of the left standard and barbell lifter assembly shown in FIG. 1.

To more fully illustrate the left and right standards 12*a* and 12*b*, FIG. 2 of the drawing shows a side-elevation view of the left standard 12*a*. The left standard 12*a* includes a back leg 22*a*, a front leg 24*a*, a top brace 26*a*, a middle brace 28*a*, a lower brace 30*a*, and a vertical brace 32*a*, all of which are formed of a suitable structural material, preferably square tubular metal, and welded together, such as at the illustrated weld lines 34*a*. The bottom of the back leg 22*a* is welded to a back floor plate 36*a*, and the bottom of the front leg 24*a* is welded to a front floor plate 38*a*. As shown in FIG. 1, the right standard 12*b* is of identical construction, including a back leg 22*b*, a front leg 24*b*, a top brace 26*b*, a middle brace 28*b*, a lower brace 30*b*, and a vertical brace 32*b*, all of which are formed of the same suitable structural material, preferably square tubular metal, and welded together at weld lines 34b. The bottom of the back leg 22b is welded to a back floor plate (not shown), and the bottom of the front leg 24b is welded to a front floor plate 38b.

Each of the standards 12a and 12b preferably has several barbell weight holders. For example, as shown in FIG. 2 of the drawing, the vertical brace 32a of the left standard 12a has four holders 40a, 42a, 44a, and 46a, that are welded at fixed positions on the back and front sides of the brace. Vertical brace 32b of the right standard 12b has four holders 40b, 42b, 44b, and 46b, that are welded at fixed positions on the back and from sides of the brace 32b. The lower portion of front legs 24a and 24b of the left and right standards 12a and 12b, respectively, can also have one or more barbell weight holders, such as holders 48a and 48b, respectively. Each of the holders is formed of short lengths, several inches for example, of round metal rod that is welded to have about a five degree (5°) rise in elevation to the horizontal.

The position of the barbell weight holders on the standards 12a and 12b is determined by the size and shape of typical barbell weights. A typical barbell weight is formed of a circular plate which has an axial hole for mounting the weight onto a barbell. Of course, for balancing the barbell, the weights are mounted in pairs on the ends of the barbell. Several different sizes of weights are required to accommodate different body-building exercises using a barbell and the different strengths of persons using the barbell. Typical barbell weights are available in sizes of 2½ lbs, 5 lbs, 10 lbs, 25 lbs, 35 lbs, and 45 lbs—the heavier the weight, the larger the diameter of the plate.

Thus, the holders 40a, 42a, 44a, and 46a on the vertical brace 32a of left standard 12a are spaced apart from the middle brace 28a and lower brace 30a and also from each other such that each holder can support weights up to one of the typical sizes without interference with the braces 28a and 30a or other weights on adjacent holders. For example, holder 40a is positioned to allow the relatively small diameter 10 lb weights to be stored, holder 42a is positioned to allow 25 lb weights to be stored, holder 44a is positioned to allow relatively large diameter 45 lb weights to be stored, and holder 46a is positioned to allow 35 lb weights to be stored. Holder 48a is positioned on the lower portion of front leg 24a to allow small 2½ lb and 5 lb weights to be stored. The holders 40b, 42b, 44b, 46b, and 48b are identically positioned on the right standard 12b. Thus, one or more barbell weights can be placed on each of the holders so that the weights can be storm on the standards 12a and 12b of the apparatus 10. The weights are retained on each holder by the slight rise in elevation of the holder. As can be best seen in FIG. 1, the holders allow barbell weights to be stored directly on the standards 12a and 12b of the apparatus 10 for ready access, but completely out of the way of a person using the equipment.

Continuing to refer to FIGS. 1 and 2 of the drawings, each of the back legs 22a and 22b of the left and right standards 12a and 12b, respectively, has several barbell squat pegs. For example, the back-facing side of back leg 22a has three squat pegs 50a, 52a, and 54a; and the back-facing side of back leg 22b has the three squat pegs 50b, 52b, and 54b. The squat pegs are preferably positioned at uniformly spaced-apart intervals along the rear facing side of the back legs. Each of the squat pegs is formed of short lengths, several inches for example, of round metal rod that is welded to have about a ten degree (10°) rise in elevation to the horizontal. The several pairs of squat pegs 50a and 50b, 52a and 52b, and 54a and 54b are positioned on each of the back legs 24a and 24b, respectively, of the left and right standards 12a and 12b, respectively, to accommodate a range of the shoulder heights of different persons who are expected to use the squat pegs for squat exercises.

Referring now to FIG. 1, a weight-lifting barbell (not shown) can be supported on a pair of the pegs, for example, the middle pegs 52a and 52b on standards 12a and 12b, respectively. The rise of the squat pegs retains a barbell on the pegs against the back-facing sides of the back legs 22a and 22b of the standards. A person can load each end of the barbell with the desired amount of the weights, which can be conveniently stored on the barbell weight holders on each of the standards 12a and 12b. The person can then stand facing rearward between the standards 12a and 12b with neck and shoulders positioned next to the middle section of the barbell, lift the loaded barbell off the pegs, such as middle pegs 52a and 52b, and perform the squat exercise. After performing the exercise, the person lowers the barbell back onto one of the sets of pegs. The weights can be unloaded from the barbell and replaced for storage on the barbell weight holders 40a and 40b, 42a and 42b, 44a and 44b, 46a and 46b, and 48a and 48b on standards 12a and 12b, respectively.

Each of the back legs 22a and 22b of the left and right standards 12a and 12b, respectively, also has a squat safety peg 56a and 56b, respectively. The squat safety pegs are preferably positioned at a relatively low height of a person's shoulders who is in a partially squatted position. Each of the squat safety pegs is formed of short lengths, several inches for example, of round metal rod that is welded to have about a ten degree (10°) rise in elevation to the horizontal. As shown in FIGS. 1 and 2 of the drawing, the squat safety pegs 56a and 56b are preferably more substantial than the other squat pegs because they may have to bear the force of a heavily loaded barbell moving downward with less control than normal. These squat safety pegs stop the downward movement of the barbell and protect the person doing the squat exercise in case the weight is too heavy for the person to lift the loaded barbell back up to one of the shoulder height squat pegs.

As an added safety feature for the squat exercise, the adjustable bench assembly 100 is preferably positioned in a horizontal position (as will described in detail). Thus, if a person performing the squat exercise experiences difficulty and cannot raise the barbell, he can lean backward and sit down on the head board of the bench assembly. This prevents the person from squatting too far down under the heavy weight, which could cause severe knee and leg damage. Most preferably, a person should always perform this exercise with safety spotters.

Continuing to refer to FIGS. 1 and 2 of the drawings, each of the front legs 24a and 24b of the left and right standards 12a and 12b, respectively, have several barbell bench-press pegs. For example, the front-facing side of back leg 24a has the seven bench-press pegs, collectively designated by the reference 58a, and the front-facing side of front leg 24b also has seven corresponding bench-press pegs, collectively designated by the reference 58b. The bench-press pegs 58a and 58b are preferably positioned at uniformly spaced-apart intervals along the front facing side of the front legs. Each of the bench-press pegs is formed of short lengths, several inches for example, of round metal rod that is welded to have about a ten degree (10°) rise in elevation to the horizontal. The several pairs of bench-press pegs 58*a* and 58*b* are positioned on each of the front legs 24*a* and 24*b*, respectively, of the left and right standards 12*a* and 12*b*, respectively, at a height to accommodate a wide range flat and inclined bench-press exercises for a person using the adjustable bench assembly 100.

Referring now to FIG. 1, a weight-lifting barbell (not shown) can be supported on one of the pairs of the bench-press pegs 58*a* and 58*b* on standards 12*a* and 12*b*, respectively. The rise of the bench-press pegs retains the barbell on the pegs against the front-facing side of the front legs of the standards 12*a* and 12*b*. A person can load each end of the barbell with the desired amount of the weights stored on the barbell weight holders on each of the standards 12*a* and 12*b*. As will hereinafter be explained in detail, the person can adjust the bench assembly 100 to be either flat or inclined, as desired. Once positioned on the bench assembly 100, the person can lift the barbell and perform a bench-press exercise. After performing the exercise, the barbell is lowered onto one of the paris of bench-press pegs 58*a* and 58*b*. If the person feels a loss of control, the barbell can be moved backward until it catches on one of the paris of bench-press pegs. The barbell weights can be unloaded from each end of the barbel and replaced for storage on the barbell weight holders 40*a* and 40*b*, 42*a* and 42*b*, 44*a* and 44*b*, 46*a* and 46*b*, and 48*a* and 48*b* on standards 12*a* and 12*b*, respectively.

Each of the left and right standards 12*a* and 12*b* also has a dead-lift barbell assembly retainer, generally referred to by the reference numerals 60*a* and 60*b*, respectively. Referring to FIG. 2, the retainer 60*a* on the left standard 12*a* is shown in more detail. The retainer 60*a* includes a vertical back slide 62*a* and a vertical front slide 64*a*. The upper ends of the slides 62*a* and 64*a* are welded to the lower brace 30*a*. The lower ends of the slides 62*a* and 64*a* are welded to a retainer brace 66*a*. The lower brace 30*a*, the slides 62*a* and 64*a*, and the retainer brace 66*a* define a vertical slot several inches high. The retainer 60*b* on the right standard 12*b* is similarly constructed. As will be described in detail, the dead-lift barbell assemblies 200*a* and 200*b* are removably connected to the retainers 60*a* and 60*b*, respectively.

As shown in FIG. 2 of the drawing, drilled through the square tubulars of the vertical brace 32*a* and lower brace 30*a* are small apertures 68*a*, 70*a*, and 72*a*. Similarly, horizontally aligned apertures are drilled in the identical positions through the square tubulars of the right standard 12*b*. As will be described in detail, these apertures are used for removably connecting the cross connector 14 to the standards 12*a* and 12*b*.

Once welded into one piece, one of the standards 12*a* or 12*b* is of a convenient size such that it can be moved and handled by one person for further assembly of the free-weight exercise apparatus 10.

Figure 3:
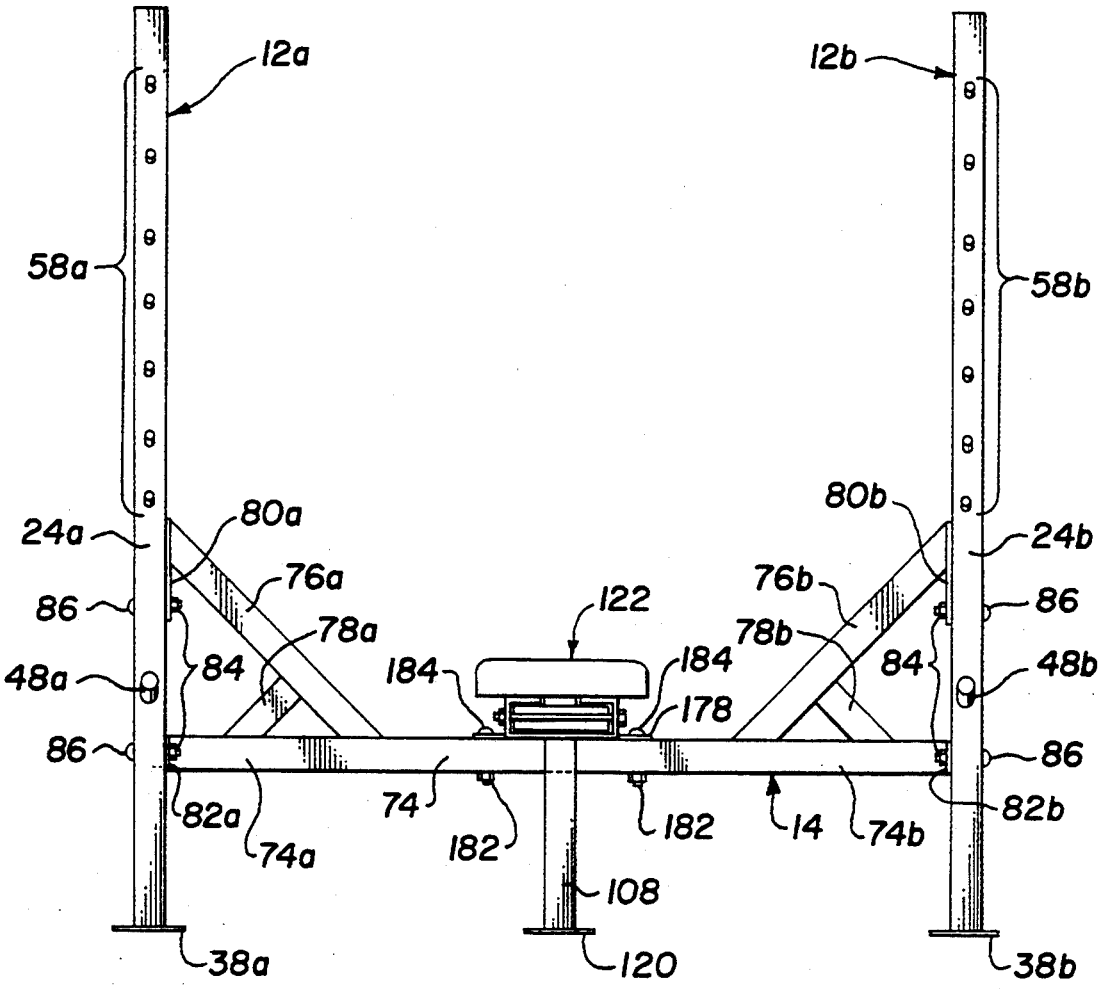
FIG. 3 is a front cross-section view of the free-weight exercise apparatus shown in FIG. 1.
Figure 4:
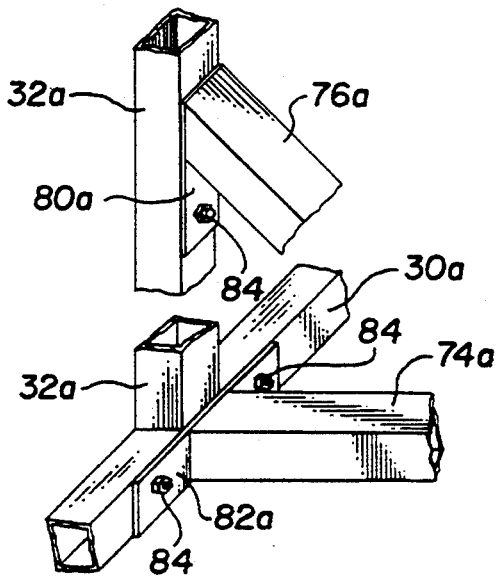
FIG. 4 is a detail illustration of the nut and bolt connection between the left standard and the cross connector shown in FIG. 3.

Turning now to FIGS. 3 and 4 of the drawings, the removable connection of the standards 12*a* and 12*b* to ate cross connector 14 is shown in more detail. The cross connector 14 has a beam 74, which has a left end portion 74*a* and a right end portion 74*b*. Welded to the left end portion 74*a* of beam 74 is a major inclined brace 76*a* and a minor inclined brace 78*a*. The minor inclined brace 78*a* helps support the major inclined brace 76*a*. Welded to the left end of the major inclined brace 76*a* is an vertical brace connector plate 80*a*; and welded to the left end of beam 74 is a lower brace connector plate 82*a*. Similarly, welded to ate right end portion 74*b* of beam 74 is a major inclined brace 76*b* and a minor inclined brace 78*b*. The minor inclined brace 78*b* helps support the major inclined brace 76*b*. Welded to the right end of the major inclined brace 76*b* is a vertical brace connector plate 80*b*; and welded to the right end of beam 70 is a lower brace connector plate 82*b*. Once welded into one piece, the cross connector 14 is of a convenient size such that it can be moved and handled by one person for fuller assembly of the free-weight exercise apparatus 10.

The connector plate 80*a* has an aperture that can be aligned with the aperture 68*a* in the vertical brace 32*a*, and the connector plate 82*a* has two apertures that can be aligned with the apertures 70*a* and 72*a* in the lower brace 30*a* of standard 12*a*. To attach the cross connector 14 to the standard 12*a*, a plurality of nuts 84 and bolts 86 are used to attach the connector plates 80*a* to the braces 30*a* and 32*a* of the standard. The cross connector 14 is similarly attached to the vertical brace 30*b* and the lower brace 30*b* of the right standard 12*b*.

As shown in FIG. 3, the adjustable bench assembly 100 is similarly removably bolted to the middle portion of beam 74 of the cross connector 14. The adjustable bench assembly 100 is of a convenient size such that it can be moved and handled by one person for assembly of the free-weight exercise apparatus 10.

Figure 5:
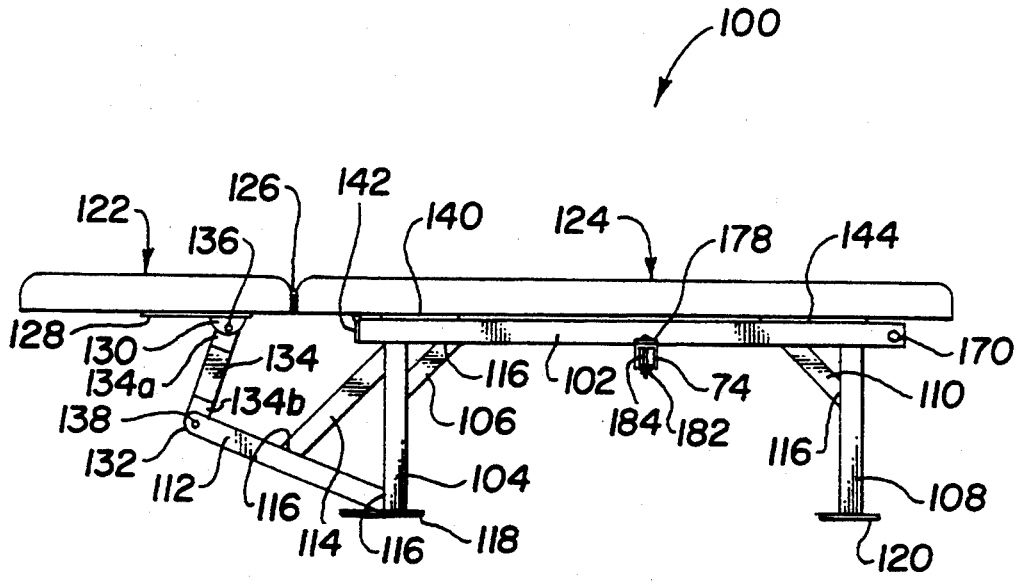
FIG. 5 is a side elevation view of the adjustable bench assembly where the bench is in a flat position.
Figure 6:
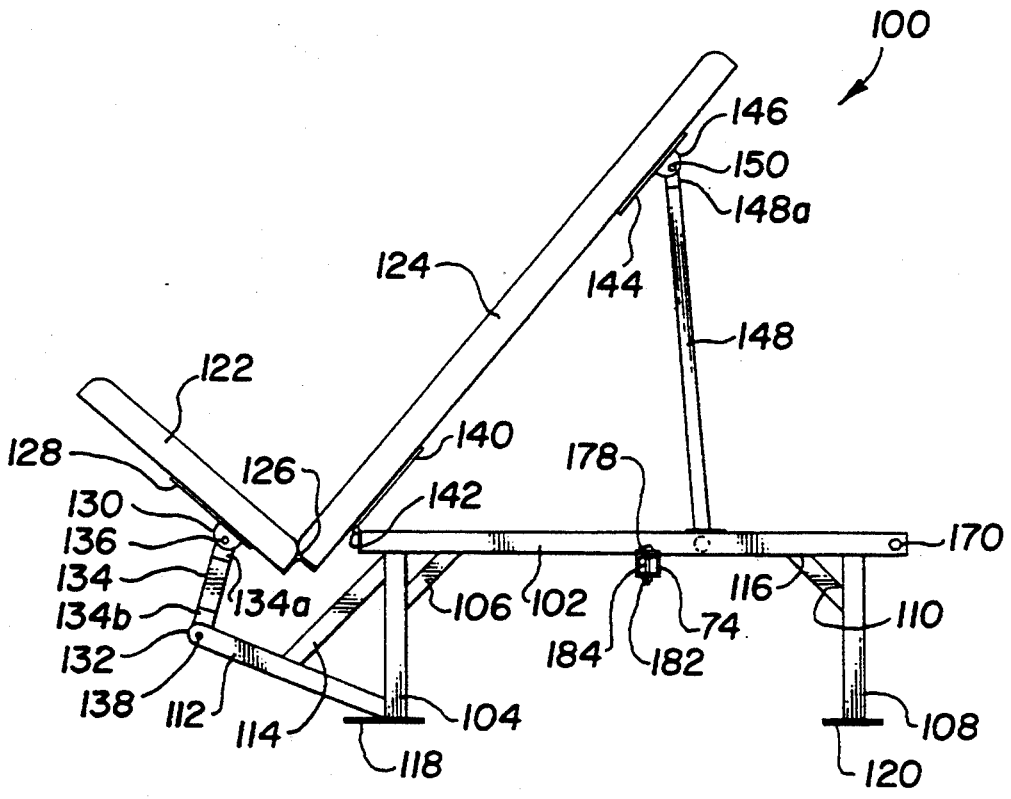
FIG. 6 is a side elevation view of the adjustable bench assembly where the bench is in an inclined position.

Referring to FIGS. 5 and 6 of the drawing, the structure and operation of the adjustable bench assembly 100 is shown in more detail. As will be described in detail with reference to FIG. 7, the bench assembly 100 includes a support track 102, which is formed of a suitable structural material, preferably a metal. Continuing to refer to FIGS. 5 and 6, the bench assembly 100 also has a fore leg 104, a fore brace 106, a rear leg 108, a rear brace 110, a toe board support arm 112, and a support arm brace 114, all of which are formed of a suitable structural material, preferably square tubular metal, and welded together, such as at weld lines 116. The bottom of the fore leg 104 is welded to a fore foot 118, and the bottom of the rear leg 108 is welded to a rear foot 120.

The bench assembly 100 also has a toe board 122 and a head board 124. The toe board 122 and head board 124 are each preferably formed of a sturdy piece of wooden board, the upper side of which is padded with cushion material, such as foam rubber, and covered with a durable material such as vinyl or plastic. The toe board 122 and head board 124 are pivotally connected by the recessed hinge 126.

The toe board 122 is rigidly attached to a metal toe board plate 128, which has a plurality of apertures therethrough (not shown) for connecting the toe board plate 128 to the exposed wooden bottom of the toe board 122 with wood screws, or more preferably, carriage bolts with nuts and washers. The carriage bolts are preferably glued in place for assisting in removing the bolts, because it is periodically necessary to replace the padded covering of the toe board. A half-moon shaped pivot connector 130 is welded to the lower surface of the toe board plate 128. The forward end of the toe board support arm 112 is also provided with a pivot connector 132. The upper end 134*a* of a linkage arm 134 is pivotally connected with an upper pin 136 to the pivot connector 130 on the toe board plate 128. Similarly, the lower end 134*b* of linkage arm 134 is pivotally connected with a lower pin 138 to the pivot connect 132 of the toe board support arm 112.

The forward end of the head board 124 is rigidly attached to a metal hinged plate 140, which has a plurality of apertures therethrough (not shown) for connecting the hinged plate 140 to the exposed wooden bottom of the head board 124 with wood screws, or more preferably, carriage bolts with nuts and washers. The carriage bolts are preferably glued in place for assisting in removing the bolts, because it is periodically necessary to replace the padded covering of the head board. One edge of the hinged plate 140 is provided with a hinge connection 142 to the forward end of the support track 102.

The rearward end of the head board 124 is rigidly attached to a metal head board plate 144, which has a plurality of apertures therethrough (not shown) connecting the head board plate 144 to the exposed wooden bottom of the head board 124 with wood screws, or more preferably, carriage bolts with nuts and washers. The carriage bolts are preferably glued in place for assisting in removing the bolts, because it is periodically necessary to replace the padded covering of the head board. As shown in FIG. 6, the head board plate 144 has a half-moon shaped pivot connector 146 is welded to the lower surface of the head board plate 144. The upper end 148*a* of a head board arm 148 is pivotally connected with a head board pin 150 to the pivot connector 146 on the head board plate 144.

Figure 7:
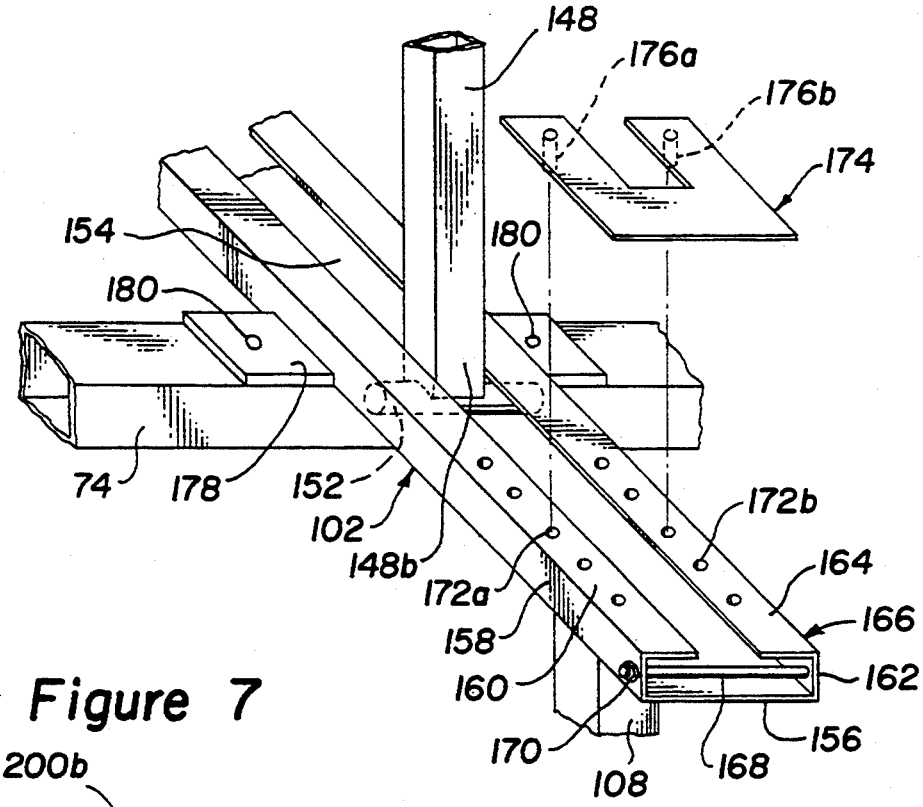
FIG. 7 is an exploded view of the support track of adjustable the bench assembly shown in FIGS. 5 and 6.

Turning now to FIG. 7 of the drawing, a cylindrical track follower 152 is welded to the lower end 148*b* of the head board arm 148. The support track 102 of the bench assembly 100 has a channel 154 that is defined by a bottom wall 156, a left wall 158, a left upper lip 160, a right wall 162, and a right upper lip 164. The space between the left and right upper walls 158 and 162 is large enough to accommodate the head board arm 148. The support track 102 has a rearward end 166. A pair of aligned apertures are drilled or otherwise formed in the rearward end 166 of left wall 158 and right wall 162 of the support track 102, through which a long bolt 168 can be inserted and removably retained in place with a nut 170. Thus, the follower 152 on the lower end 148*b* of the head board arm 148 can be inserted into the channel 154 at the rearward end 166 of the support track 102, and then retained within the channel 154 by the long bolt 168. 7he head board arm 148 can move with the follower 152 along the length of the channel 154 of the support track 102.

A plurality of apertures, such as the pair of apertures 172*a* and 172*b*, are formed in the left upper wall 158 and right upper wall 162, respectively, of support track 102. The apertures are, formed as spaced apart intervals along the length of at least the rearward end 166 of the support track 102. A generally C-shaped lock plate 174 is used to adjustably retain the head board arm 148 in a desired position. The lock plate 174 has a pair of pegs 176*a* and 176*b* that can be aligned with one of the pairs of apertures formed in the upper walls 158 and 162 of support track 102, such as the pair of apertures 172*a* and 172*b*. Thus, the pegs 176*a* and 176*b* of the lock plate 174 can be positioned in apertures 172*a* and 172*b* to removably hold the head board arm 148 in a desired position.

Referring back to FIG. 5, when the follower 152 is moved all the way to the rearward end of the support track 102, the head board arm 148 fits between the left and right upper walls 158 and 162 and into the channel 154. The combination of the several pivotal connections of the recessed hinge 126, upper pin 136, lower pin 138, hinged connection 142, and head board pin 150 allow the toe board 122 and head board 124 to move into a horizontally aligned position as shown in FIG. 5, so that the bench assembly 100 can be used for horizontal bench-press exercises.

Referring back to FIG. 6, to move the toe board 122 and head board 124 into an inclined position, the head board 124 is lifted so that the follower 152 moves along the channel 154 of the support track 102. The C-shaped lock plate is positioned in one of the pairs of apertures in the upper walls 158 and 162 of support track 102, such as the pair of apertures 172*a* and 172*b*. Thus, the C-shaped lock plate retains the head board arm 148 in the desired position. The combination of the several pivotal connections of the recessed hinge 126, upper pin 136, lower pin 138, hinged connection 142, and head board pin 150 allow the toe board 122 and head board 124 to reciprocally move into a inclined positions as shown in FIG. 5, so that the bench assembly 100 can be used for inclined bench-press exercises. The degree of incline is determined by the position of the lock plate 174. Thus, the toe board 122 is automatically moved into the correct position to retain a person on the bench while performing incline bench press exercises.

As shown in FIGS. 5–7 of the drawings, an attachment plate 178 is welded to the bottom of the middle portion of the support track 102 for removably connecting the adjustable bench assembly 100 to the beam 74 of cross connector 14 of the apparatus 10. The plate has a plurality of apertures 180 formed therein for bolting the bench assembly 100 to the beam 74, using nuts 182 and bolts 184. The adjustable bench assembly 100 is of a convenient size such that it can be moved and handled by one person for assembly of the free-weight exercise apparatus 10.

Figure 8:
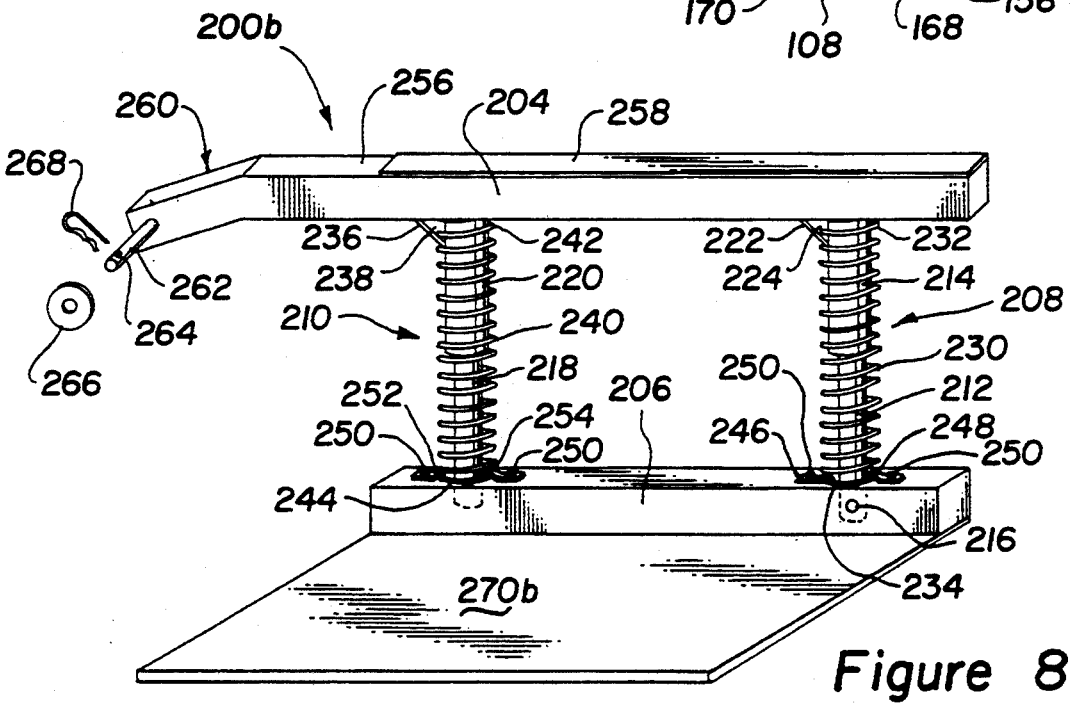
FIG. 8 is an exploded view of the right barbell lifter assembly.

The lifter assemblies 200*a* and 200*b* are used to assist a person in a dead-lift type exercise by reducing the amount of work required to start the upward motion of the dead lift. Referring to FIG. 8 of the drawing, one of the barbell lifter assemblies, specifically the right barbell lifter assembly 200*b*, is shown in more detail. It is to be understood that the references to forward and rearward are with respect to the assembly 200*b* as it would be attached to the apparatus shown in FIG. 1.

The lifter assembly 200*b* includes an upper bar 204 and a lower bar 206, which are formed of a suitable structural material, preferably square tubular metal. The two bars 204 and 206 are attached by a rearward piston-cylinder unit 208 and a forward piston-cylinder unit 210. The rearward piston-cylinder unit 208 includes a piston 212 and a cylinder 214 that telescope together. Preferably, the piston-cylinder units telescope several inches. The piston of each piston-cylinder unit is preferably formed of a cylindrical body having a cylindrical outer wall. The cylinder of each unit preferably is preferably formed of a cylindrical body have a hollow, cylindrical interior wall, whereby the piston can reciprocate within the cylinder. The telescoping inner and outer walls of the piston-cylinder unit can be lubricated with oil, or more preferably, graphite. But it is to be understood that a square, hexagonal, or other configuration for the telescoping piston-cylinder units can be employed.

The piston 212 is connected with a swivel pin connector 216 in a generally perpendicular orientation to a rearward portion of the lower bar 206, and the cylinder 214 is welded perpendicularly to a rearward portion of the upper bar 204. Similarly, the forward piston-cylinder unit 210 includes a piston 218 and a cylinder 220. But the piston 2 18 is preferably welded perpendicularly to a forward portion of the lower bar 206, and the cylinder 220 also is welded perpendicularly to a forward portion of the upper bar 204. As will be, explained in more detail, the pivotal connection of one of the pistons of the two piston-cylinder units is important because it allows play in the exact orientation of the piston, which prevents the piston-cylinder units 208 and 210 from binding under an uneven load.

A relatively small strip of metal 222 is welded as shown between the upper bar 204 and the outer wall of cylinder 214 of rearward piston-cylinder unit 208, which defines a small, triangular opening 224. Rearward spring 230 has an upper end 232 and a lower end 234. To attach the upper end 232 of the rearward spring 230 to the upper bar 204 and the cylinder 214, the upper end 232 of the rearward spring 230 is placed circumferentially over the cylinder 214, threaded through the triangular opening 224, and wound in a "cork-screw" manner for at least one full revolution, whereby the upper end of the spring 232 is hooked through the opening 224. Similarly, a relatively small strip of metal 236 is welded as shown between the upper bar 204 and the outer wall of cylinder 220 of rearward piston-cylinder unit 210, which defines a small, triangular opening 238. Forward spring 240 has an upper end 242 and a lower end 244. To attach the upper end 242 of the forward spring 240 to the upper bar 204 and the cylinder 220, the upper end 242 of the rearward spring 240 is placed circumferentially over the cylinder 220, threaded through the triangular opening 238, and wound in a "cork-screw" manner for at least one full revolution, whereby the upper end 242 of the spring 240 is hooked through the opening 238.

The two pistons 212 and 218 are axially aligned with the cylinders 214 and 220, respectively, and positioned through the lower ends of springs 232 and 240. The lower end 234 of spring 232 is attached to the lower bar 206 by a pair of clips 246 and 248, which are bolted to the lower bar 206 with bolts 250. Similarly, the lower end 244 of spring 240 is attached to the lower bar 206 by a pair of clips 252 and 254 with bolts 250. Thus, the springs 232 and 240 retain the piston-cylinder units and the upper and lower bars 204 and 206 together.

Attached to the upper surface 256 of upper arm 204 is a strip of padding material 258, such as neoprene rubber. The strip of padding material 258 is preferably bonded to the upper arm 204 with an adhesive. This reduces the noise of a loaded barbell landing on the lifter assembly and also provides some friction resistance to a barbell rolling off the lifter assembly.

Referring now to both FIGS. 1 and 8, the forward end of upper arm 204 has an extension portion 260 for removably connecting the lifter assembly **200*b* to the right standard 12*b* of the apparatus 10. A connecting rod 262 is welded to the extension portion 260 of the upper arm 204. The connecting rod 262 can be positioned in the retainer 60*b* on the right standard 12*b* between the vertical back slide and a vertical front slide, which are similar to the slides 62*a* and 64*a* of retainer 60*a* on the left standard 12*a*. The connecting rod 262 has a small aperture 264 on the end thereof so that the rod 262 can be secured to the retainer 60*b* the body of the arm 204 on the one side and by a washer 266 and a hitch pin 268 on the other. Similarly, the left lifter assembly 200*a* can be removably attached to the retainer 60*a* of the left standard 12*a*. Each of the lifter assemblies 200*a* and 200*b* is are of a convenient size such that they can be moved and handled by one person for assembly of the free-weight exercise apparatus 10**.

Each of the barbell lifter assemblies **200*a* and 200*b* has a mat 270*a* and 270*b*, respectively. The lifter assemblies are preferably designed such that when a heavily loaded barbell placed on the assemblies, the piston-cylinder units 208 and 210 allow a maximum drop of the upper bar 204 of only a few inches. But it can be possible that the largest diameter barbell weights loaded onto the barbell would prevent the barbell from fully depressing the upper bar 204 when the peripheral edge of the weight comes into contact with the mats 270*a* and 270*b*. The mats prevent the barbell weights from damaging the flooring supporting the apparatus 10**.

Continuing to refer to both FIGS. 1 and 8, to perform a dead-lift exercise, a weight-lifting barbell (not shown) can be positioned across the padded portions 258 of the lifter assemblies **200*a* and 200*b*. A person can load each end of the barbell with the desired amount of the weights stored on the barbell weight holders on each of the standards 12*a* and 12*b*. The person can then stand with knees next to the middle section of the barbell and between the barbell lifter assemblies 200*a* and 200*b* and grasp the barbell. The springs 232 and 240 counterbalance at least a portion of the weight of the loaded barbell so that the person can begin the upward lifting motion of the barbell easier and perform the dead-lift exercise. After performing the exercise, the barbell is lowered, or even dropped, back onto the lifter assemblies 200*a* and 200*b*. The springs 232 and 240 of each of the lifter assemblies 200*a* and 200*b* absorb at least some of the impact of the barbell. The swivel pin connector of the piston 216 prevents the two piston-cylinder units 208 and 210 from binding, even though the barbell is not centered on the strip of padding material 258. The weights can be unloaded from the barbell and replaced for storage on the barbell weight holders 40*a* and 40*b*, 42*a* and 42*b*, 44*a* and 44*b*, 46*a* and 46*b*, and 48*a* and 48*b* on standards 12*a* and 12*b***, respectively.

The barbell lifter assemblies **200*a* and 200*b* can be rotated upward from the floor about the rod 262 that is secured to the retainers on the left and right standards 12*a* and 12*b*, respectively. Thus, when not in use, the apparatus 10 requires less floor space, which can be, for example, as little as 4 feet by 4 feet, which is defined by the placement of front and back floor plates 36*a*, 36*b*, 38*a*, and 38*b*. Rotating the lifter assembly upward also facilitates cleaning of the floor around the apparatus 10, and under the mats 270*a* and 270*b***.

Figure 9:
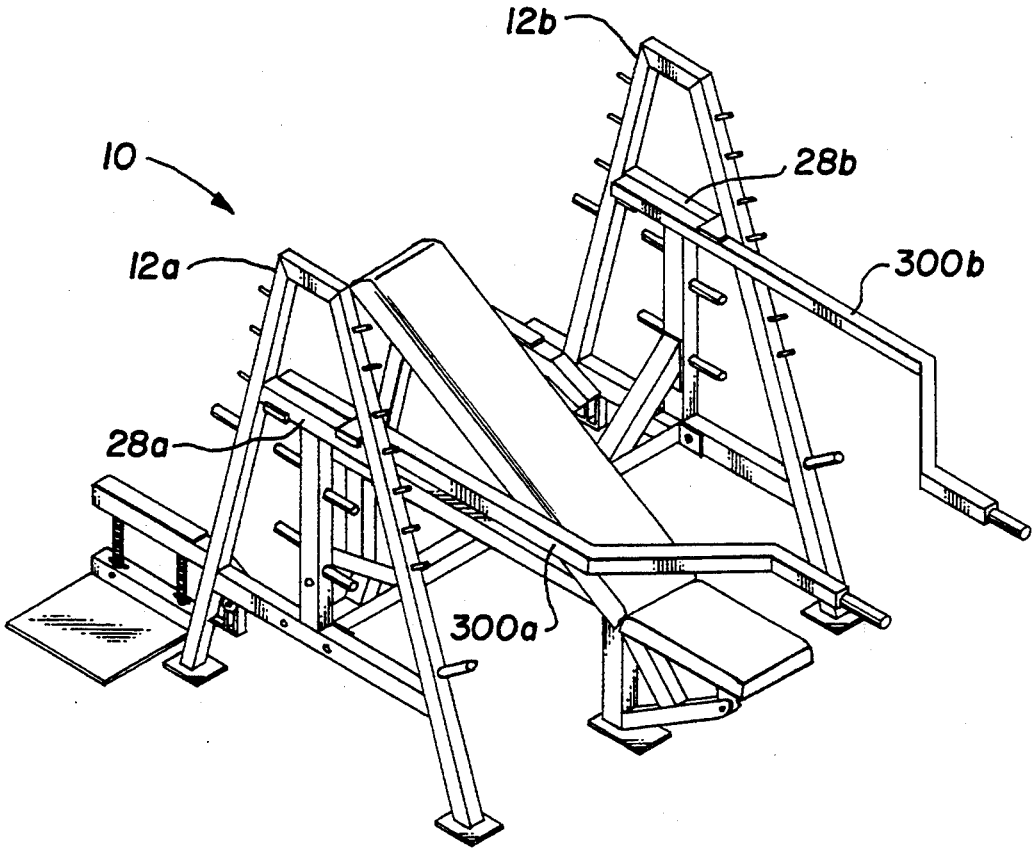
FIG. 9 is a perspective view of the apparatus of FIG. 1 showing the optional placement of parallel bar dip arms on the standards.

Turning to FIG. 9 of the drawings, the apparatus 10 is illustrated with a left and right hand pair of removable dip bars **300*a* and 300*b*, which can be removably attached to the middle braces 28*a* and 28*b* of left and right standards 12*a* and 12*b***, respectively.

Figure 10:
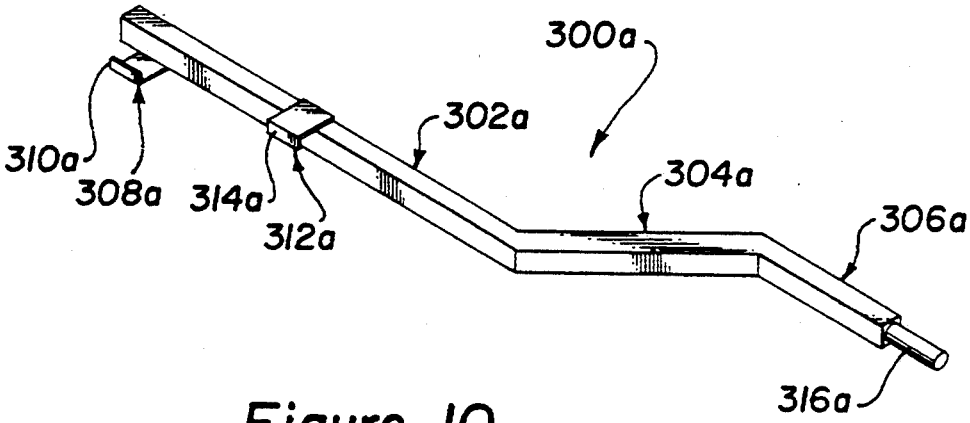
FIG. 10 is a perspective view of the left parallel bar dip arm.

The structure of one of the dip bars, specifically the left hand dip bar **300*a* is shown in more detail in FIG. 10. The bar 300*a* is preferably formed of a suitable structural material, such as square tubular metal. The bar 300*a* has a rear portion 302*a*, a middle portion 304*a*, and a forward portion 306*a*. The rearward portion 302*a* has a first brace 308*a* formed of a metal plate that is welded to the bottom side of the rear portion 302*a*. The brace 308*a* extends out to the left. The first brace 308*a* has an upturned lip 310*a*. The rearward portion 302*a* also has a second brace 312*a* formed of a metal plate that is welded to the upper side of the rear portion 302*a*. The second brace 310***a* extends out to the left, and has a downturned lip 314*a*. The middle portion 304*a* of the dip bar 300*a* jogs to the right. The forward portion 306*a* of the dip bar 300*a* projects forward and has a handle 316*a*, which is preferably rounded and padded to provide a solid hand grip.

The right hand dip bar 300*b* is similarly constructed, but is right handed mirror image of the left hand dip bar 300*a*. The bar 300*b* has a rear portion 302*b*, a middle portion 304*b*, and a forward portion 306*b*. The rearward portion 302*b* has a first brace 308*b* formed of a metal plate that is welded to the bottom side of the rear portion 302*b*. But the brace 308*b* extends out to the right. The first brace 308*b* has an upturned lip 310*b*. The rearward portion 302*b* also has a second brace 312*b* formed of a metal plate that is welded to the upper side of the rear portion 302*b*. But the second brace 310*b* extends out to the right, and has a downturned lip 314*b*. The middle portion 304*b* of the dip bar 300*a* jogs to the left. The forward portion 306*b* of the dip bar 300*b* projects forward and has a handle 316*b*, which is preferably rounded and padded to provide a solid hand grip.

As shown in FIG. 9, the dip bars 300*a* and 300*b* are removably attached to the middle braces 28*a* and 28*b* of the standards 12*a* and 12*b*, respectively. For example, to place the left dip bar 300*a* in position, the bar is simply to position the first portion 302*a* adjacent the inside surface of the middle brace 28*a* at an angular position to the horizontal such that the first brace 308*a* and its lip 310*a* are below the lower surface middle brace 28*a* while the second brace 312*a* and its lip 314*a* are above the upper surface of middle brace 28*a*, and then moving the dip bar 300*a* in a scissor-like manner respective to the middle brace 28*a* to lock the braces 308*a* and 312*a* in place. The right dip bar 300*b* is similarly connected to the middle brace 28*b* of the right standard 12*b*. The locking design provides a new and unique way of mounting parallel dip bars to an exercise apparatus.

The parallel dip bars 300*a* and 300*b* can be used to perform parallel bar dip exercises. A person can stand between the dip bars 300*a* and 300*b*, placing the hands on the padded handles 316*a* and 316*b*. The person lifts his body up with the arms to perform the exercise. After the exercise, the dip bars 300*a* and 300*b* can be lifted off the middle braces 28*a* and 28*b* of the standards.

The entire apparatus 10 can be assembled for deliver in a few major components, specifically, the left and right standards 12*a* and 12*b*, the cross connector 14, the adjustable bench assembly 100, the left and right barbell lifter assemblies 200*a* and 200*b*, and the parallel dip bars 300*a* and 300*b*. These components can be shipped in three or four shipping boxes of convenient size, and removably connected together by one person with relatively few bolts. Thus, the apparatus requires a relatively small amount of space for the number of important free-weight exercises supported by the apparatus and is relatively portable.

The description and drawings of the specific examples above do not point out what an infringement of this patent would be, but are to provide at least one explanation of how to make and use the invention. Numerous modifications and variations of the preferred embodiments can be made without departing from the scope and spirit of the invention. Thus, the limits of the invention and the bounds of the patent protection are measured by and defined in the following claims.

Having described the invention, what is claimed is:

1. An apparatus for assisting a person with a barbell exercise by reducing the amount of effort required to start the upward motion of the barbell, the apparatus comprising: a left lifter assembly and a right lifter assembly, each of the lifter assemblies having an upper bar and a lower bar that are maintained in parallel, aligned, and spaced-apart relationship by two piston-cylinder units, wherein a spring is positioned circumferentially and co-axially around each of the piston-cylinder unit of each of the left and right lifter assemblies such that the piston-cylinder units keep the springs in vertical alignment and prevent the springs from bowing out of vertical position, whereby the springs assist in counterbalancing some of the weight of a barbell and absorbs some of the shock of a dropping barbell, and wherein one end of one of the two piston-cylinder units is pivotally connected to one of the bars and the other ends of the two piston-cylinder units are rigidly connected to the upper and lower bars, whereby the pivotal connection of one end of the two piston-cylinder units allows play in the alignment of the piston-cylinder units, which prevents the two units from binding even when the weight of the barbell is not centered between the two piston-cylinder units of the lifter assembly.

2. An apparatus according to claim 1, further comprising: a left standard and a right standard, the standards being generally triangular in shape, each of the left and right standards having a back inclined leg, a front inclined leg, and intermediate braces, the left and right standards being connected and supported by a cross connector, the left and right lifter assemblies being connected to the front inclined legs of the left and right standards, respectively.

3. An exercise apparatus according to claim 2, wherein the intermediate braces of each of the standards has several barbell weight holders for storing weights directly on the left and right standards of the apparatus.

4. An exercise apparatus according to claim 2, wherein each of the back legs of the left and right standards, respectively, has several barbell squat pegs that are positioned at uniformly spaced-apart intervals along a rear facing surface of the back legs, each of the squat pegs being formed to have about a ten degree (10°) rise in elevation to the horizontal, the squat pegs being positioned on each of the back legs of the left and right standards, respectively, to accommodate a range of shoulder heights, whereby when a person stands between the back legs of the left and right standards to perform a squat exercise, a barbell can be supported near the person's particular shoulder height.

5. An exercise apparatus according to claim 4, wherein each of the back legs of the left and right standards also has a squat safety peg, the squat safety peg being formed to have about a ten degree (10°) rise in elevation to the horizontal, and being positioned lower than the squat pegs, the squat safety pegs being more substantial than the squat pegs to bear the force of a heavily loaded barbell moving downward with less control than normal.

6. An apparatus according to claim 2, wherein each of the front legs of the left and right standards has several barbell bench-press pegs, the bench-press pegs being positioned at uniformly spaced-apart intervals along a front facing surface of the front legs, and each of the bench-press pegs being formed to have about a ten degree (10°) rise in elevation to the horizontal.

7. An apparatus according to claim 2, wherein an adjustable bench assembly is removably connected to the cross connector between the left and right standards for performing bench press exercises.

8. An apparatus according to claim 7, wherein the adjustable bench assembly includes a track, having a first end and a second end, and a toe board support arm adjacent a first end of the track, the track and toe board support arm being supported by a leg structure, the track and toe board support arm for supporting a toe board and a head board, wherein an edge of the toe board and an edge of the head board are positioned adjacent to one another, and the two boards are pivotally connected by a hinge along their adjacent edges, one end of a linkage arm is pivotally connected to the back of the toe board, and the other end of the linkage arm is pivotally connected to the toe board support arm, the end of the head board near the hinge with the toe board is pivotally connected to one end of the track, the other end of the head board has one end of a head board arm pivotally mounted to the back of the head board, and a track follower is attached to the other end of the head board arm to move along the track, a plurality of apertures being formed in the track at spaced-apart intervals along the length of at least a portion of the track, and a pin for adjustably retaining the head board arm and follower at a desired position along the track, whereby the toe board and head board pivot reciprocally between a horizontal position and a range of inclined positions, such that in an inclined position the head board is inclined between about 45° to 60° to the horizontal and the toe board is inclined substantially perpendicular to the head board.

9. An apparatus for assisting a person with a weight-lifting exercise wherein a barbell is lifted upward from the apparatus for performing an exercise, after which the barbell is lowered back down to the apparatus, the apparatus comprising: left and right lifter assemblies, each of the lifter assemblies having an upper bar and a lower bar, the bars of each lifter assembly being maintained in a parallel, spaced-apart relationship by a first vertically oriented piston-cylinder unit and a second vertically oriented piston-cylinder unit, each of the first and second piston-cylinder units having an upper end and a lower end, and each of the piston-cylinder units being co-axially aligned with a vertically oriented spring that assists in counterbalancing at least some of the weight of the barbell as it is being lifted off the upper bars and absorbs some of the shock of the barbell as it is being lowered onto the upper bars, wherein one end of the first piston-cylinder unit is pivotally connected to one of the upper and lower bars and the other end of the first piston-cylinder unit is rigidly connected to the other of the upper and lower of the bars, and wherein the upper end of the second piston-cylinder unit is rigidly connected to the upper bar and the lower end of the second piston-cylinder unit is rigidly connected to the lower bar, whereby binding of the piston-cylinder units is prevented.

10. An apparatus according to claim 9, further comprising: left and right standards, the standards being connected by a cross-connector, each of the standards having a slot retainer for connecting the upper bar of one of the lifter assemblies to the standard, whereby the standards and cross-connector provide structural support for the left and right lifter assemblies such that the upper bars of the assemblies are maintained in parallel, spaced-apart relationship, and each of the upper bars of the lifter assemblies can reciprocate vertically in the slot retainer.

* * * * *

UNITED STATES PATENT AND TRADEMARK OFFICE

CERTIFICATE OF CORRECTION

PATENT NO. : 5,433,687

DATED : JULY 18, 1995

INVENTOR(S) : HINZMAN

It is certified that error appears in the above-indentified patent and that said Letters Patent is hereby corrected as shown below:

Column 2, lines 11 and 12, "squaring" should be -- squatting --;
Column 7, line 52, "storm" should be -- stored --;
Column 9, line 62, "ate" should be -- the --;
Column 12, line 28, "port:ion" should be -- portion --;
Column 13, line 3, "2 18" should be -- 218 --;
Column 16, line 9, "unit" should be -- units --.

Signed and Sealed this

Third Day of October, 1995

Bruce Lehman

*Attest:*

BRUCE LEHMAN

*Attesting Officer*

*Commissioner of Patents and Trademarks*